United States Patent [19]

Carmo

[11] Patent Number: 4,900,035

[45] Date of Patent: Feb. 13, 1990

[54] APPARATUS AND METHOD FOR PLAYING A CARD TOSS GAME

[76] Inventor: Robert A. Carmo, 407 Michel Pl., Placentia, Calif. 92670

[21] Appl. No.: 202,592

[22] Filed: Jun. 6, 1988

[51] Int. Cl.[4] ..... A63B 67/00

[52] U.S. Cl. ..... 273/401; 273/DIG. 26

[58] Field of Search ..... 273/398–402, 273/344–347, 348, 409, 336–339, 353, DIG. 26

[56] References Cited

U.S. PATENT DOCUMENTS

| | | | |
|---|---|---|---|
| 145,914 | 12/1873 | Smith | 273/334 |
| 289,032 | 11/1883 | Sears | 273/409 |
| 593,343 | 11/1897 | Whitney | 273/400 |
| 713,704 | 11/1902 | SMith | 273/409 X |
| 1,114,523 | 10/1914 | Revell | 273/398 X |
| 3,100,642 | 8/1963 | Goldstein | 273/398 X |
| 3,647,216 | 3/1972 | Breslow | 273/DIG, 26 X |
| 4,167,267 | 9/1979 | Romero et al. | 273/353 |
| 4,305,587 | 12/1981 | O'Grady | 273/345 |
| 4,433,841 | 2/1984 | Kim et al. | 273/338 |

FOREIGN PATENT DOCUMENTS

| | | | |
|---|---|---|---|
| 6943 | 4/1894 | United Kingdom | 273/353 |

OTHER PUBLICATIONS

The Way to Play, Paddington Press Ltd. ©1975, 3–1976 p. 128, "Brother Jonathan".

*Primary Examiner*—Paul E. Shapiro
*Attorney, Agent, or Firm*—Beehler & Pavitt

[57] ABSTRACT

The play and entertainment value of a card toss game is substantially enhanced by combining the tossing of a plurality of cards, each having an erratic flight behavior or path, with a game board having a plurality of pockets defined therein for receiving the cards if successfully tossed and a counter built into the game board for accumulating scores attributed to the tossed cards and adding additional scoring values. The plurality of pockets of the game board are distinguished one from each other in that at least one of the pockets has a shape and size which allows cards to be more easily tossed therein than the others. Additional ones of the pockets are further uniquely associated with selected ones or suits of the cards so that scores within these pockets are counted depending upon the type of cards successfully tossed into each pocket. Movement of a counter token accumulates the score of each player and additionally adds bonus or penalty points or provides for sudden grand slam victory depending upon play calls, position of the token counter on the game board and score received from the toss of the card into one of the plurality of pockets.

1 Claim, 2 Drawing Sheets

APPARATUS AND METHOD FOR PLAYING A CARD TOSS GAME

BACKGROUND OF THE INVENTION

1. Field of the Invention

The invention relates to the field of games and in particular to a card toss game.

2. Description of the Prior Art

Card tossing is a play element well known for both single and multiple players and has typically comprised the tossing of single playing cards from graduated distances away from a hat or bowl. The cards are shuffled and distributed to the players with either the number of cards which land in the hat being counted for a score or the face value of the card being counted as score.

The distance of the player from the bowl is typically increased to increase difficulty and is sometimes used as a handicap among players of different skills or ages. While the number of play elements and rules in card tossing are extremely simple, the play value which is obtained is unusually high due to the combination of random chance which arises from the difficulty of throwing a highly non-aerodynamic and uncontrollable ballistic, the card, into a hat with such hand-eye coordination which can be brought to bear to minimize the randomness which arises from the complex aerodynamics of the tossed card.

What is needed is a method and apparatus for providing a play element and entertainment which enhances the high play value of card tossing games, but which retains the simplicity underlying the basic playing dynamics of card toss.

BRIEF SUMMARY OF THE INVENTION

The invention is a game comprising at least one card. The card is hand tossed and is characterized by potentially highly unstable aerodynamic flight. A board provides a plurality of targets or pockets for the card. Each target is arranged and configured to receive the card upon predetermined conditions relating to the toss of the card toward the board and its reception or lack of reception by the target or pocket.

As a result, play and scoring combinations between the card and the board is substantially enhanced.

The game further comprises a counter element for accumulating score as attributable to a combination of the card and the board upon the toss of the card toward the board.

The card can be considered as comprising a plurality of thin planar cards having a predetermined shape and size. The plurality of targets provided by the board are each characterized by a selected size and shape.

In the preferred embodiment, the card comprises a plurality of thin planar cards having a predetermined shape and size. Each of the targets provided by the board provides at least one predetermined orientation wherein the planar card may be disposed within the target. Other orientations of the card prohibit disposition of the card within the target.

The counter comprises at least one distinguishably configured status for signifying a correspondingly distinguishable scoring significance to be attributed to the toss of the card to the board.

The counter element is included within the board and is comprised of at least one token movable through a sequential plurality of determinable positions defined within the board. At least one of the positions signifies the distinguishably configured status of the counter element. In particular, the one distinguishably configured position represents a cumulative score achieved by repeated toss of the cards and signifies sudden grand slam victory. In another sense, the distinguishably configured position corresponds to a predetermined cumulative score relating to repeated tosses of the card element and signifies a penalty assessed to opponents.

The invention is also a method for enhancing the play value of a card toss game comprising the steps of tossing at least one card toward a game board. The game board has a plurality of distinguishable targets defined therein. A distinguishable score is attributed to each tossed card depending upon combinations of the card and the distinguishable target into which the card may be disposed within the game board. As a result, erratic aerodynamic flight of the card while tossed is combined with selected play significance depending upon the target of the game board with which the card becomes associated by virtue of the toss.

The method further comprises repeating the steps of tossing and attributing and then accumulating the attributed scores for the repeated steps by movement of a token counter piece among a plurality of distinguishable positions on the game board.

The method still further comprises the step of attributing additional scoring significance to accumulated scores by virtue of final position resulting from the movement of the token among the plurality of positions.

The step of attributing additional scoring comprises the step of predicting a move to a predetermined distinguishable location on the game board, tossing the card, attributing the score with respect to the card and declaring successful movement to the predicted position as a sudden grand slam victory.

The step of attributing additional scoring comprises the step of moving the token to at least one predetermined position, according to the steps of tossing the card and attributing a score with respect to the tossed card, and then penalizing each other player a predetermined score therefor.

The invention is still further characterized as an improvement in a card toss game comprising a plurality of cards characterized by an erratic flight when tossed. The improvement comprises a game board for providing a plurality of receiving pockets. The plurality of pockets are of at least two distinguishable configurations. Each distinguishable configuration is distinguished by the probability of and ease of disposition of the game card into the pocket upon being hand tossed toward the game board. A counter element is used for accumulating the score attributed to each card successfully tossed into one of the distinguishable pockets of the game board element. As a result, play and entertainment of the card toss game is substantially enhanced.

The two distinguishably configured pockets are distinguished by the area of access to the pocket available to the tossed card.

The two distinguishably configured pockets are additionally distinguished by the shape of the pocket, the shape determining probability and ease of access of the tossed card into the pocket.

For example, the two distinguishably configured pockets are distinguished by the area of access to the pocket available to the tossed card. The two distinguishably configured pockets are alternately distinguishable by identifiable association with a selected subplurality of the plurality of cards tossed toward the pockets within the game board element.

The invention may be better visualized by now turning to the following Figures wherein like elements are referenced by like numerals.

The invention and its various embodiments may be better understood by now turning to the following detailed description.

DETAILED DESCRIPTION OF THE PREFERRED EMBODIMENTS

The play and entertainment value of a card toss game is substantially enhanced by combining the tossing of a plurality of cards, each having an erratic flight behavior or path, with a game board having a plurality of pockets defined therein for receiving the cards if successfully tossed and a counter built into the game board for accumulating scores attributed to the tossed cards and adding additional scoring values. The plurality of pockets of the game board are distinguished one from each other in that at least one of the pockets has a shape and size which allows cards to be more easily tossed therein than the others. Additional ones of the pockets are further uniquely associated with selected ones or suits of the cards so that scores within these pockets are counted depending upon the type of cards successfully tossed into each pocket. Movement of a counter token accumulates the score of each player and additionally adds bonus or penalty points or provides for sudden grand slam victory depending upon play calls, position of the token counter on the game board and score received from the toss of the card into one of the plurality of pockets.

The play element and entertainment value of a card tossing game is substantially enhanced by utilizing a specialized game board in combination with the tossed cards. The playing cards, which may be specially printed or shaped as described below, or may simply be a convention set of playing cards, are utilized in combination with a game board having segmented compartments or areas for receiving the tossed cards. In the illustrated embodiment, the game board is three-dimensional, but it is to be expressly understood that two-dimensional game boards are included within the scope of the invention. The game board is provided with means for accumulating scores for each player and graphically depicting the relative scores of each player as compared to the other players, as well as depicting how many additional points must be accumulated by a player to win. Points are scored by the player by tossing a card from a predetermined distance onto or into the game board.

In the illustrated embodiment, the card will fall and come to rest within a sectionalized compartment if successfully thrown and then accorded a specific score. The player than moves his token on the game board according to the score which he has made. Thereafter, the next player takes his turn and so on in sequence for each player. The tokens are thus advanced on the game board toward a final goal. The first player to reach the goal wins. Movement of the tokens on the game board is also used to award bonus or penalty points to enliven the play sequence.

Figure 1:
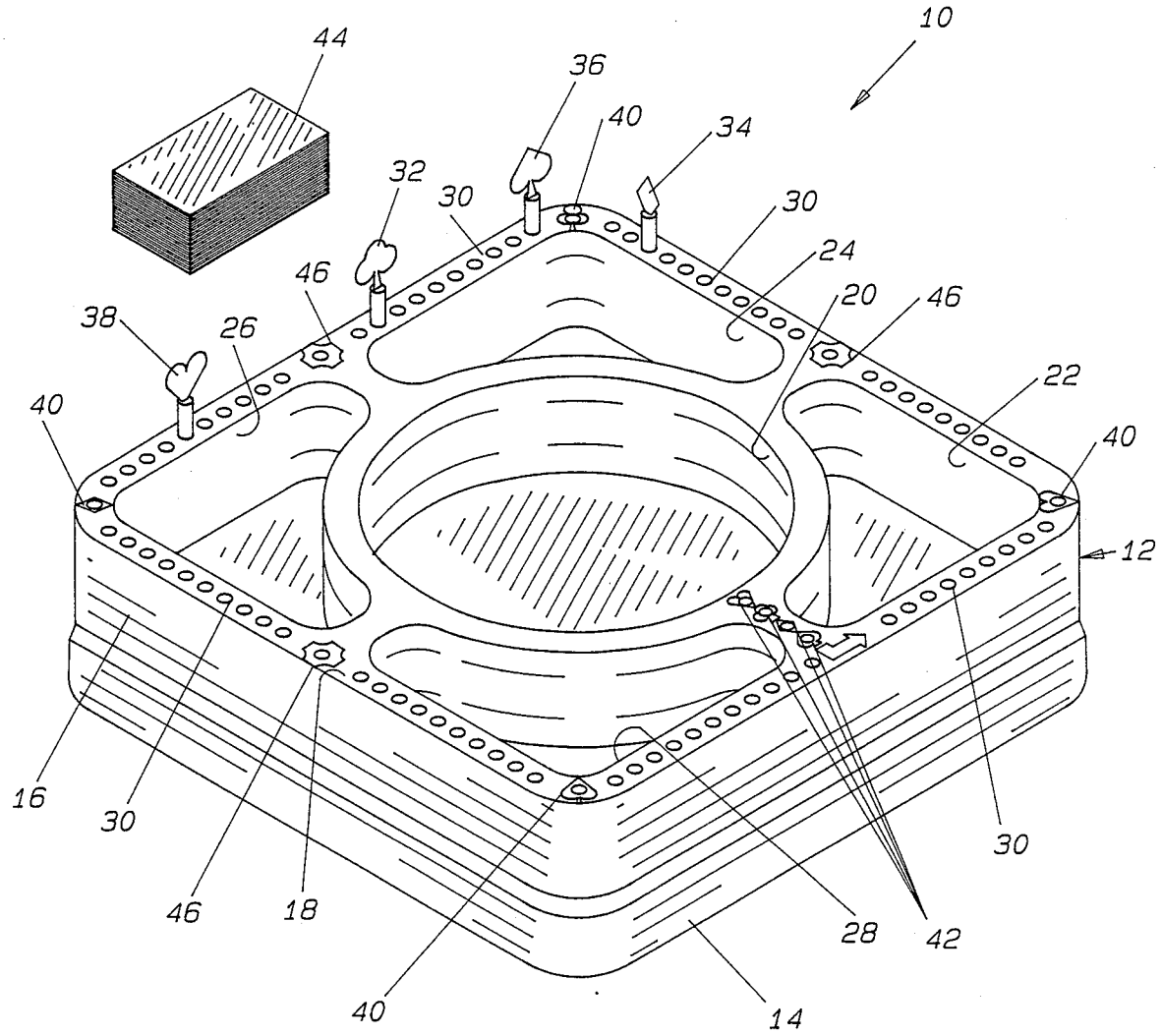
FIG. 1 is a perspective view of the preferred embodiment of the threedimensional game board incorporating the invention.

Turn to the illustrated embodiment which is depicted in perspective view in FIG. 1. FIG. 1 shows a three-dimensional game board, generally denoted by reference numeral 10. Game board 10 in the illustrated embodiment is square or frame-like in outline and is comprised of a single piece, molded body 12. Body 12 is comprised of a decorative lower lip 14 which integrally rises from basal lip 14 to form, in outline, a truncated quadrilateral pyramidal shape. Thus, sides 16 are slightly chamfered or tapered inwardly as they transition from basal lip 14 to upper rail 18. The interior of game board 12 has a plurality of shaped compartments or pockets defined therein, namely a central pocket 20 and four symmetrically shaped and disposed radial compartments 22–28.

Figure 2:
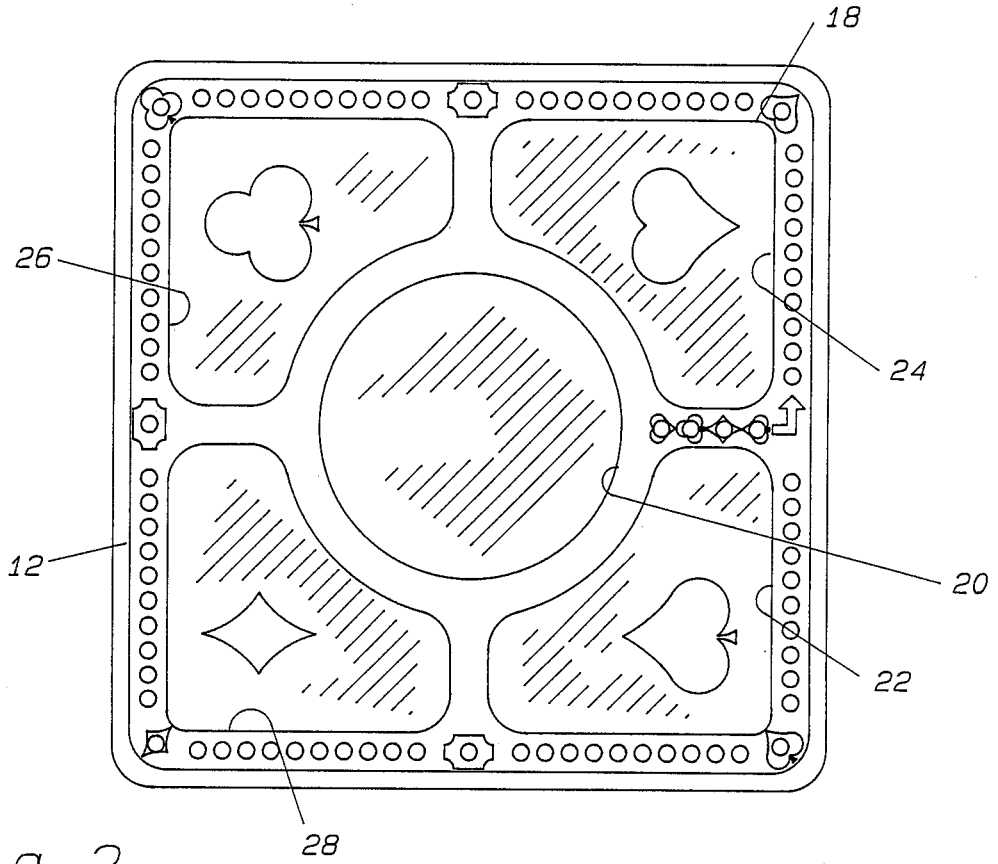
FIG. 2 is a plan elevational view of the game board shown in FIG. 1.

In the illustrated embodiment central pocket 20 is a circular pocket centered on the center of game board 10, while each of the pockets 22–28 as best depicted in the plan elevational view of FIG. 2, are identically shaped and symmetrically disposed about central pocket 20 to occupy the remaining volume of body 12 of game board 10 with the exception of the separation of the areas between each pocket 20–28 provided by upper rail 18. In the illustrated embodiment, each pocket 22–28 is separated from each of the other pockets and has such a size and shape that a conventionally sized and shaped set of playing cards can be tossed into any one of the pockets 22–28 and flatly lie in place on the bottom of each of the pockets if appropriately oriented therein.

Central circular pocket 20 is the largest pocket and being cylindrical has no preferred orientation in the plane of body 12. Thus, a card can be tossed and received by circular pocket 20 regardless of its orientation in the plane of the game board. On the other hand, each of the pockets 22–28 is curvilinearly shaped in cross section and thus have at least one preferred direction in which a tossed card must be oriented if it is to be received within pockets 22, 24, 26 or 28. In addition, the planar area of pockets 22–28 is measurably less than the planar area of central circular pocket 20. Therefore, the combination of the different and planar area available as a target and the restrictions on orientation of the playing card which can be accepted within each pocket changes the difficulty by which a card may be tossed and received into various ones of the pockets. In the illustrated embodiment pocket 20 is the easiest in which to toss a card while pockets 22–28 are more difficult with the degree of difficulty due to pocket size and shape being equal among the four pockets 22–28. Each of pockets 20–28 may have a decal, decoration or felt mat disposed within or on the bottom the pocket to carry appropriate symbols thereon for scoring purposes.

Upper rail 18 of body 12 is provided with a multiplicity of holes 30 for receiving a plurality of tokens 32–38. Each token is distinguished so that it may be uniquely identified with a player. In the illustrated embodiment, since the use of a conventional deck of playing cards is contemplated, each token is three-dimensionally shaped to represent one of the four suits of a conventional deck, one suit of which will be assigned to each player. Similarly, one or more symbols are provided to uniquely associate each of the radial pockets 22–28 with one of the suits and hence with one of the players. In the illustrated embodiment as best shown in FIG. 2, the symbol for the card suit is printed or otherwise depicted on the bottom of its respective pocket 22–28 and in addition a similar suit emblem is molded or otherwise depicted on the corners 40 of upper rail 18 of body 12 corresponding to the player's pocket.

The play elements now having been described, consider the method whereby the elements are manipulated and combined to enhance the play activity of card tossing. To begin each player is assigned a tossing distance based upon a recommended distance chart provided with the game. This may be the distance from a chair to game board 10 measured according to the age or skill of the player. For example, players of age 7 and under should be positioned six feet away from game board 10 while players of 8 to 11 years at seven feet, 12 to 15 years at eight feet, and players 16 years and older at nine feet.

Game board 10 is placed on the floor and some type of marker or masking tape is placed on the floor away from the game board at the recommended player distance from the front or nearest edge of the game board to the player. Once play begins, the tossing distance for each player remains fixed. Each of the tokens 32–38 begins at a home position within holes 42 defined within upper rail 18 of game board 10, such as that hole corresponding to the suit corresponding to token 32–38. The object of the game is to completely circle game board 10 by moving the token from the starting hole 42 counterclockwise (or oppositely) around the game board along its outer peripheral upper rail 18, counting one point for each advance among holes 30 until the token is returned to its home position 42.

Each player is assigned one of the suits from deck 42 and is provided with the thirteen cards of the suit. This is called his "hand". Spades begins first followed by diamonds, clubs and then hearts. A player can also win by scoring a "grand slam", that is by landing exactly on the corner 40 carrying his suit's symbolic depiction after calling for such a move prior to the first toss of the player's hand. Points are scored by tossing cards into center pocket 20 or that corner suit pocket 22, 24, 26 or 28 which has been assigned to the player. Cards tossed in an remaining in the center pocket 20 are accorded a score as follows:

Ace, 25 points;
Joker 25 points;
Face card 15 points;
All others, face value.

Cards tossed in assigned corner suit pocket receive double score above;

At least one card tossed in all five pockets, player receives 50-point bonus;

Cards balancing on top rail 18 do not count as points, scoring cards must rest within a pocket to be supported by cards within a pocket to score. No score is counted for cards tossed in an opponent's corner suit pocket except for bonus points.

After the player tosses all the cards in his hand the total points are added and his token is moved along top rail 18 accordingly.

After the first round, a player whose token is in last place is given a joker to toss in addition to the thirteen cards of his suit. A joker scores as an extra ace.

If a player's token comes to rest after the tossing of all of his cards in that corner 40 carrying his designated suit, he is given an additional 14 points and his token is moved ahead accordingly. As previously stated, a player has an automatic victory or grand slam if he predicts that he will move to his assigned corner position prior to tossing his first card of any hand. However, only the first card tossed and only if predicted will the player to then be able to claim a grand slam and victory. A grand slam will preempt victory from any other player who has circled the game board and returned to his starting position during the same round.

If the players prefer, optional grand slam rules may be utilized. For example, center pocket 20 and the assigned corner pocket 22, 24, 26 or 28 as appropriate may be used for scoring the grand slam card or alternatively only the assigned corner pocket may be so utilized in order to increase the difficulty of making a grand slam.

If during the game a player's token lands on the corner 40 of an opponent, he receives a penalty of 15 points and therefore moves his token 15 holes 30 away from the goal or home position 32.

Similarly, if a player moves his token such that it would come to rest on the token of another player, he receives a single bonus point and moves his token to the next hole 30 in advance of the opponent.

Further, if any player lands on one of three mid-position holes 46 on upper rail 18, each of which holes 46 are specially designated or distinguished, then the tokens of each of the opposing players are moved back on upper rail 18 by 15 points or holes.

When a player circles game board 10 and returns to his starting position, the remaining players are allowed to complete the last round. If during the last round more than one player returns to the start, the winner is determined by sudden-death one-hand toss-off without using the joker. The player who obtains most point on the sudden-death toss-off is declared the winner.

When circling game board 10, the player need not return his token to home position 42 by an even count. Any excess remaining points are simply disregarded. However, as an optional rule and in order to making finishing more even between players of unequal skill, it may be agreed in advance that the token may be returned to home positions 42 only by an exactly even count on the last hand. If a player scores in the hand points in excess of those required to evenly return him to his home position, he forfeits all points scored in that round and must wait for the next round in order to attempt to score exactly the number of points required to return to his home position.

The basic play described above may be modified in many ways without departing from the spirit and scope of the invention. For example, instead of each player being assigned a single suit, players may team together as partners. For example, one group of players may take the black suits, spades and clubs, while the opposing group takes the red suits, diamonds and hearts. Each player is assigned one suit as previously described. However, after one player has retired his token to the home position, he must then continue to play and apply his points to his partner's token. The team returning both of its tokens first is then the team to win.

Similarly, in a sudden-death play-off in the event of a tie between teams, the combined score of the card in the sudden-death round is utilized to determine which team wins. In team play any single player scoring a grand slam as discussed above will then automatically win the game for his team.

Play most fairly proceeds from tossing cards with each player in a sitting position. This tends to avoid unfairness due to long reach or leaning. Each player must remain seated with both feet in from of him and on the ground. All players should toss from the same seat which is moved toward or away from game board 10 according to the player's recommended distance. The cards from deck 44 may be tossed in any order, either face up or face down. However, the cards should be tossed only one at a time. All thirteen cards must be tossed in turn. Only the last-place player is allowed to toss the joker in addition to his thirteen regular cards. As the player's skill improves, the tossing distance for that player can he increased appropriately, although nine feet is the maximum recommended distance for satisfactory play.

As described above, the play proceeds rapidly and with a graphic depiction of the relative progress of each player against the other players by virtue of the position of his token on upper rail 18. In addition, placement of tokens on upper rail 18 as described above adds an additional play element and chance beyond that required for mere scoring and in addition to the play and chance element which arises by virtue of the card toss.

The illustrated embodiment has been shown in FIGS. 1 and 2 as a three-dimensional square playing board 10. However, as previously stated, other shapes, sizes and configurations are expressly contemplated. For example, the same game board as discussed above may be utilized simply as a two-dimensional version which would then appear in perspective in a view consistent with that implied from the top elevational view of FIG. 2. In such a case, a card would score only if it does not overlap with any portion of a printed rail 18. Similarly, in a two-dimensional embodiment three-dimensional tokens 32–38 could be substituted with flat movable tokens and holes 30 substituted by printed spots on the periphery of rail 18 of game board 10.

Again, although in the illustrated embodiment a three-dimensional game board having a depth of approximately two to three inches is illustrated, other means of providing pockets consistent with the teaching of the invention could be provided. For example, a substantially two-dimensional game board as suggested by FIG. 2 would be provided into which grooves would be made which would in turn define pockets 20–28. A means for separating the pockets could then be inserted into the grooves such as an appropriate flexible metal divider, a series of pegs or the like.

Still further, the players could be provided with a plurality of rigid or deformable container shapes which could be fitted within a retaining framework similar to body 12 of game board 10 but which would then divide the interlying space into a plurality of pockets with various point assignments or significance according to the teachings of the invention.

Figure 3:
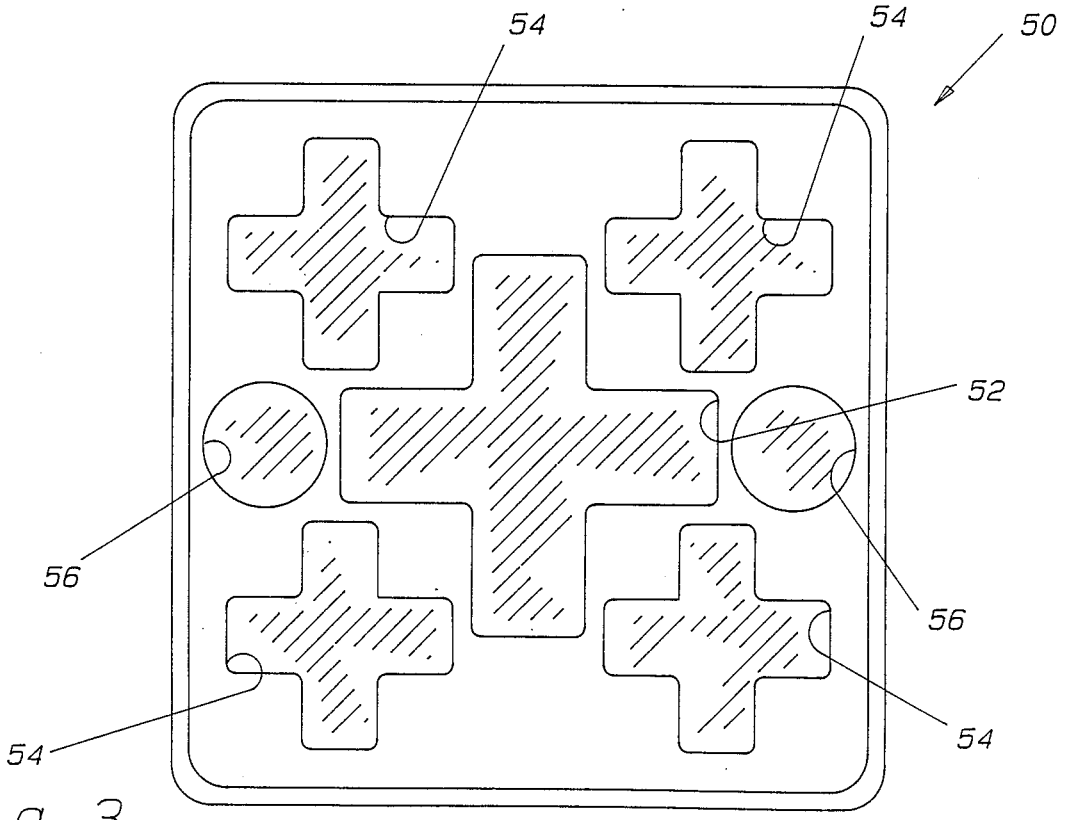
FIG. 3 is a plan elevational view of an alternative embodiment of the game board utilized in the invention.

FIG. 3 represents one such embodiment in which a plurality of pockets are fixed in a game board generally denoted by reference numeral 50. FIG. 3 is a plan elevational view of game board 50 similar to FIG. 2 which would appear in three dimensions similar to the perspective view of FIG. 1. Game board 50 is characterized by a large central cross-shaped pocket 52 and is symmetrically surrounded by four smaller cross-shaped pockets 54. Other shaped pockets may be included within game board 50 such as square, rectangular, triangular or circular shapes 56 having a diameter at least as large as one of the dimensions of the playing cards from deck 44.

Therefore, FIG. 3 represents a game board embodiment wherein each of the cross-shaped pockets 52 and 54 has two preferred directions of orientation in which the playing card must be aligned in order to enter the pocket. In the case of the smaller cylindrical pockets 56, the playing card must enter the pocket vertically or have its smaller dimension aligned with a diameter of cylindrical pocket 56. According to the teachings of the present invention a special significance or score could then be assigned to each of the pockets 54 as opposed to the more easily accessible central pocket 52 with a high bonus point provided for the difficultly accessible cylindrical pockets 56.

Although in the foregoing a conventional rectangular card has been contemplated, it is also expressly within the scope of the invention that specially shaped cards such as diamond cut card, circular disc-shaped cards, square cards, triangular cards or the like, or combinations of such shapes, each with a different score value, may similarly be employed in combination with correspondingly shaped pockets defined in the game board. Thus, not only can the aerodynamics of the tossed card be altered by its shape, mass and curvatures, but also the probability by which such a card when tossed would easily access a pocket can also be affected. The cards may be shaped, for example, to be received in only one type of receiving pocket. Several differently shaped cards would then be provided to each player who must then toss them into the pockets which are complementarily shaped to receive only a specifically shaped card.

Therefore, many modifications and alterations may be made by those having ordinary skill in the art without departing from the spirit and scope of the invention. The illustrated embodiment has been set forth only for the purpose of example and should not be taken as limiting the invention as defined in the following claims.

I claim:

1. A game comprising:

at least one card means, said card means for providing a hand tossed element with potential highly unstable aerodynamic flight; and board means for providing a plurality of targets for said card means, each target arranged and configured to receive said card means upon predetermined conditions with respect to said toss of said card means toward said board means, wherein said card means comprises a plurality of thin planar cards having a predetermined shape and size, wherein each of said targets provided by said board means provides at least one predetermined orientation of said planar card wherein said planar card may be disposed within said target, other ones of said orientation prohibiting disposition of said card within said target, whereby play and scoring combinations between said card means and said board means is substantially enhanced.

* * * * *